US005202727A

United States Patent [19]

Izumizaki et al.

[11] Patent Number: 5,202,727

[45] Date of Patent: Apr. 13, 1993

[54] MULTI-COLOR IMAGE FORMING APPARATUS WITH BLACK AND WHITE IMAGE FORMING MODE

[75] Inventors: Masami Izumizaki, Yokohama; Ikuo Kuribayashi, Tokyo, both of Japan

[73] Assignee: Canon Kabushiki Kaisha, Tokyo, Japan

[21] Appl. No.: 774,330

[22] Filed: Oct. 10, 1991

[30] Foreign Application Priority Data

Oct. 11, 1990 [JP] Japan ..... 2-273583
Oct. 9, 1991 [JP] Japan ..... 3-262096

[51] Int. Cl.[5] ..... G03G 5/00; G03G 15/01

[52] U.S. Cl. ..... 355/211; 355/326

[58] Field of Search ..... 355/211, 326, 327, 210, 355/272; 430/59, 46, 56, 96

[56] References Cited

U.S. PATENT DOCUMENTS

| | | | |
|---|---|---|---|
| 4,483,610 | 11/1984 | Takada | 355/297 |
| 4,531,828 | 7/1985 | Hoshino | 355/272 X |
| 4,577,954 | 3/1986 | Kajiwara | 355/326 |
| 4,580,889 | 4/1986 | Hiranuma et al. | 355/327 |
| 4,660,077 | 4/1987 | Kawamura et al. | 355/327 X |
| 4,809,037 | 2/1989 | Sato | 355/327 X |
| 4,893,179 | 1/1990 | Ito | 355/327 X |
| 4,935,788 | 6/1990 | Fantuzzo et al. | 355/326 |
| 4,987,455 | 1/1991 | Lubberts | 355/326 X |
| 5,002,845 | 3/1991 | Shimura et al. | 430/59 |
| 5,014,094 | 5/1991 | Amitani et al. | 355/326 |
| 5,034,296 | 7/1991 | Ong et al. | 430/59 |
| 5,041,877 | 8/1991 | Matsumoto | 355/326 X |
| 5,063,130 | 11/9991 | Kato et al. | 430/96 |
| 5,081,507 | 1/1992 | Monkelbaan et al. | 355/327 X |

*Primary Examiner*—A. T. Grimley
*Assistant Examiner*—Sandra L. Brasé
*Attorney, Agent, or Firm*—Fitzpatrick, Cella, Harper & Scinto

[57] ABSTRACT

In a multi-image forming apparatus having a plurality of electrophotographic photosensitive members and adapted to form a multi-image by sequentially transferring image formed on the photosensitive drums onto a transfer sheet, it is possible to the service life of the photosensitive member having the higher frequency in use. To this end, the photosensitive member having the higher frequency in use has a different construction which differs from those of the other photosensitive members. Further, if necessary, an image forming method by the photosensitive member having such different construction is differentiated from those by the other photosensitive members.

32 Claims, 2 Drawing Sheets

MULTI-COLOR IMAGE FORMING APPARATUS WITH BLACK AND WHITE IMAGE FORMING MODE

BACKGROUND OF THE INVENTION

1. Field of the Invention

The present invention relates to a multicolor or full-color image forming apparatus for copying machines, electrophotographic printers and the like.

2. Related Background Art

In the past, electrophotographic systems, ink jet recording systems, thermal transfer recording systems and the like have been proposed as recording systems for forming a full-color image. Among them, as disclosed in U.S. Pat. No. 4,483,610, an electrophotographic system utilizing a single photosensitive member can be operated at a high speed and can use a plain paper therefore it has recently been developed more and more. In order to achieve the high speed operation, a technique of increasing the number of revolutions of the photosensitive member has been proposed. However, to further increase the speed of the operation, a system having a plurality of photosensitive members corresponding to the number of colors tends to be esteemed.

More specifically, as disclosed in U.S. Pat. No. 5,014,094, a recording system having four electrophotographic photosensitive members corresponding to cyan, magenta, yellow and black colors for obtaining a full-color image is suitable for the high speed operation, since it can obtain the full-color image merely by feeding a transfer sheet in a straight feeding path.

However, in an image forming apparatus having a plurality of photosensitive members corresponding to the number of colors, when a mono-color image is copied from a black and white original other than a full-color original, the image forming operation including the latent image formation, development, transfer, cleaning and the like is performed only with respect to the photosensitive member associated with the black color. Thus, a surface of this photosensitive member tends to wear faster and greater than the other photosensitive members, with the result that the black color photosensitive member must be replaced more frequently than the other color photosensitive members, thereby reducing the efficiency and increasing maintenance.

SUMMARY OF THE INVENTION

An object of the present invention is to provide an image forming apparatus which can prevent the great difference in the durability due to the frequency in use of photosensitive members corresponding to different colors.

In order to achieve the above object, the present invention provides a multi-image forming apparatus having a plurality of electrophotographic photosensitive members and adapted to form a multi-image by sequentially transferring images formed on the respective photosensitive members onto a transfer sheet, comprising a plurality of image forming stations having a plurality of electrophotographic photosensitive members arranged along a transfer sheet feeding direction and adapted to form toner images of different colors on the respective photosensitive members, a transfer sheet conveying means for conveying a transfer sheet to transfer portions of the image forming stations, and a transfer means for transferring the toner images formed at the image forming stations onto the transfer sheet. Wherein only the toner image formed on any of the photosensitive members can be transferred onto the transfer sheet and a portion of the photosensitive members has a construction different from those of the other photosensitive members.

DETAILED DESCRIPTION OF THE PREFERRED EMBODIMENTS

First of all, a first embodiment of the present invention will be explained.

Figure 1:
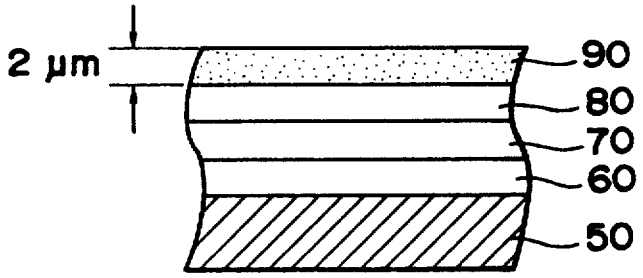
FIG. 1 is a partial sectional view of a photosensitive drum for a black colors.

FIG. 1 is a partial enlarged sectional view of an electrophotographic photosensitive drum for a black color in a multi-image forming apparatus according to the present invention, which has the greatest frequency in use.

This photosensitive drum is composed of a cylindrical core 50 made of aluminum (Al), an under cover layer (UCL) 60 formed on the cylindrical core, a carrier generating layer (CGL) 70 formed on the under cover layer and comprising holes and electrons for generating carriers, a carrier transport layer (CTL) 80 formed on the carrier generating layer and adapted to transport the carriers, and a protection layer or outer cover layer (OCL) 90 formed on the carrier transport layer and made of Teflon (trademark) for lengthening the service life of the photosensitive drum.

Figure 2:
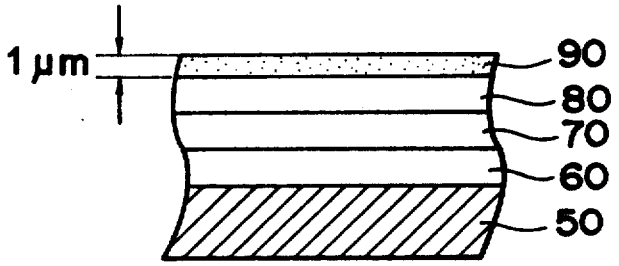
FIG. 2 is a partial sectional view of each of photosensitive drums for other colors.

The protection layer 90 of this photosensitive drum has a thickness of 2 μm which is greater than the thickness of 1 μm of each of photosensitive drums for other colors as shown in FIG. 2, thus lengthening the service life of this drum more than those of other photosensitive drums.

Figure 3:
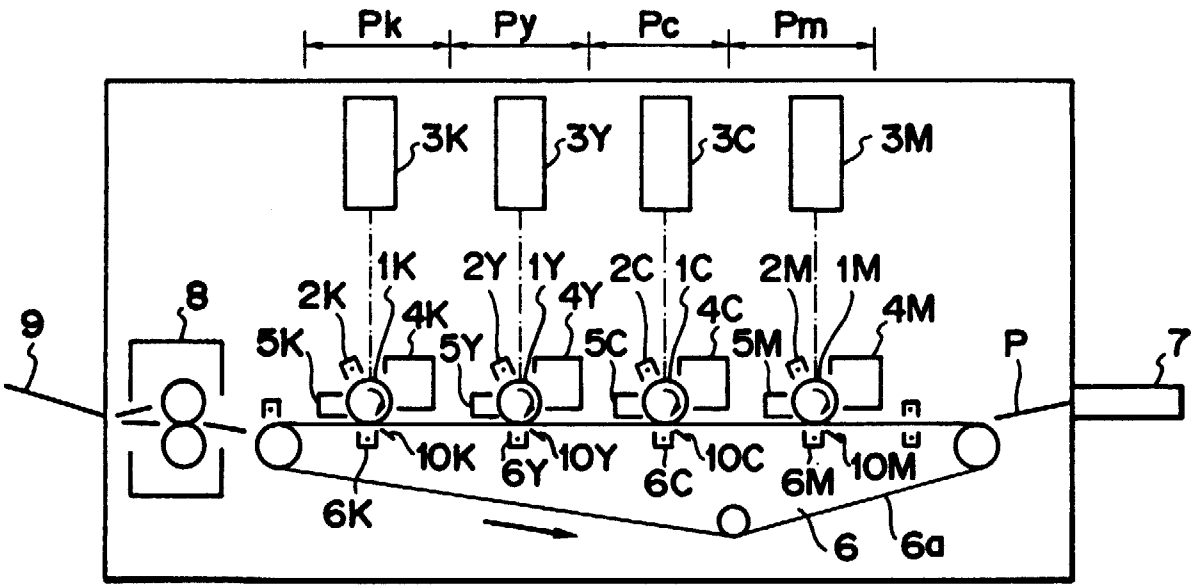
FIG. 3 is an elevational sectional view of a multi-image forming apparatus according to the present invention.

FIG. 3 shows a laser beam printer having a plurality of optical scanning means each utilizing a laser beam, and four photosensitive drums.

This printer serves to output a copy of a color original image read by an image reader (not shown) and has four image forming stations Pm ~ Pk for different colors each comprising an image forming means arranged around a corresponding electrophotographic photosensitive drum. Toner images formed on the photosensitive drums at the respective image forming stations are transferred onto the same transfer sheet carried by a belt-shaped moving body moving in confronting relation to the photosensitive drums.

More particularly, photosensitive drums 1M, 1C, 1Y, 1K are arranged in image forming stations Pm, Pc, Py, Pk for magneta, cyan, yellow and black colors, respectively, and are rotated in directions shown by the arrows (clockwise directions), respectively. Further, around the photosensitive drums 1M, 1C, 1Y, 1K, there are disposed corresponding image forming means comprising corona dischargers 2M, 2C, 2Y, 2K, optical scanning devices (optical scanning means) 3M, 3C, 3Y, 3K, developing devices 4M, 4C, 4Y, 4K, and cleaners 5M, 5C, 5Y, 5K, respectively.

Further, a transfer portion 6 forming a part of the image forming means is used with the image forming stations in common and includes a transfer belt 6a for conveying a transfer sheet P by electrostatically adhering the sheet thereto, and transfer chargers 6M, 6C, 6Y, 6K associated with the corresponding drums 1M, 1C, 1Y, 1K, respectively. A full-color image can be obtained by sequentially transferring the toner images of different colors formed on the respective photosensitive drums onto the transfer sheet P carried by the transfer belt 6a. Incidentally, the transfer sheet P is supplied from a sheet supply cassette 7. After the transferring operation, the sheet P is separated from the transfer belt, and then is ejected onto a tray 9 through a fixing device 8.

Each of the optical scanning devices 3M, 3C, 3Y, 3K comprises a laser beam source (not shown), a polygonal mirror (not shown) for scanning the laser beam from the laser beam source, an fθ lens (not shown) for focusing the scanning laser beams on the generatrix of a surface of the photosensitive drum, a reflection mirror (not shown) for deflecting a bundle of the scanning laser beams, and a beam detection means for detecting a specific position of the scanning laser beam. Since these elements are well-known, the explanation thereof will be omitted.

Next, a process control of the image formation for carrying out the present invention in the better condition will be explained.

Since the protection layer 90 of the organic photosensitive drum acts as an insulation layer, if it is thickened, the residual electric potential will be increased. Thus, it is advantageous to perform the pre-exposure process for reducing the residual electric potential and to increase an amount of light in the exposure process only with respect to the photosensitive drum for black color. For example, it was found that, when the photosensitive drum was uniformly charged to a voltage V before exposure, if the inner cover layer 60 and the carrier transport layer 80 of the drum included dye of phthalocyanine group, it was preferable to use the pre-exposure light amount of 1.5 lux/sec for the photosensitive drum for black color including the protection layer having the thickness of 2 μm, and the pre-exposure light amount of 0.5 lux/sec for the photosensitive drums for the other colors each including the protection layer having the thickness of 1 μm. Although the photosensitive drums for respective colors are worn due to the sliding contact between the drums and blade brushes of the respective cleaners 5M, 5C, 5Y, 5K, it was found that the service life of the drum for black color became longer than those of the drums for other colors by 2~3 times. At the same time, the drawback that the residual electric potential is increased due to the increase in the thickness of the protection layer was eliminated by increasing the pre-exposure light amount regarding the photosensitive drum for black color.

As a result, it was found that, even when the photosensitive drum for black color was used more frequently than the other photosensitive drums, the photosensitive drum for black color did not prematurely become nonusable.

Next, a second embodiment of the present invention will be explained.

Another disadvantages caused when the protection layer 90 of the photosensitive drum is thickened is that the formed image becomes dim. In order to solve this problem, it is effective to increase an amount of light during the exposure of the latent image. To this end, it is preferable that the exposure light amount for the photosensitive drum for black color is set to a given half-tone level, for example, 0.7 lux/sec for 50% duty image, and the exposure light amounts for the photosensitive drums for the other colors are set to 0.4 lux/sec.

Incidentally, if the layer of any photosensitive drum is thickened, since a circumferential length of that drum becomes longer than those of the other drums, a shifting amount of the circumferential length of that drum per a unit time will differ from those of the other drums, with the result that a shifting speed given by that drum will greater than those given by the other drums. If such difference in speed occurs, it is effective to adjust the rotational speeds of the drums in accordance with the thickness of the protection layers of the drums. That is to say, when a radius of the photosensitive drum for black color is $r_1$ and the rotational speed thereof is $\omega_1$, and radii of the photosensitive drums for the other colors are $r_1$ and the rotational speeds thereof are $\omega_2$, since a relation $r_1\omega_1=r_2\omega_2$ (=v) is satisfied, the rotational speed of the drum for black color may be selected on the basis of the following equation:

$$\omega_2=(r_1/r_2)\times\omega_1.$$

Next, a third embodiment of the present invention will be explained.

In the above-mentioned embodiments, while the protection layer 90 of the photosensitive drum for black color was thicker than those of the photosensitive drums for the other colors, in this third embodiment, only the protection layer of the photosensitive drum for black color is made of material having the high durability.

The material having the high durability can be selected from amorphous silicone (a-Si) and selenium (Se) which have been conventionally used with high speed electrophotographic copying machines. In this way, by using such organic material having the high durability (expensive) only as the protection layer of the photosensitive drum for black color and using the ordinary inorganic material (inexpensive) as the protection layers of the photosensitive drums for the other colors, it is possible to provide an inexpensive multi-image forming apparatus which is improved in view of the maintenance.

Next, a fourth embodiment of the present invention will be explained.

In the above third embodiment, while the protection layer of the photosensitive drum for black color was made of the material having the high durability, in this fourth embodiment, the protection layers of all of the photosensitive drums are made of the same inexpensive inorganic material and the frequency in use of the surface of the protection layer of the photosensitive drum for black color alone is substantially reduced, thus lengthening the service life of the photosensitive drum for black color.

More particularly, a diameter of the photosensitive drum for black color shown in FIG. 3 becomes greater than those of the photosensitive drums for the other colors. For example, the diameter of the photosensitive drum for black color is selected to have a value of 20 cm and the diameters of the photosensitive drums for the other colors are selected to have a value of 10 cm. In this way, even when the same inexpensive inorganic material is used to constitute the protection layers of all of the photosensitive drums, if the frequencies in use of all drums are the same, the service life of the photosensitive drum for black color will be twice as long as the service life of the photosensitive drums for the other colors. In this case, since only the photosensitive drum for black color is made large-sized, the whole apparatus is not made bulky excessively.

Incidentally, in this case, as described in connection with the second embodiment, when the radius of the photosensitive drum for black color is $r_1$ and the rotational speed thereof is $\omega_1$, and the radii of the photosensitive drums for the other colors are $r_1$ and the rotational speeds thereof are $\omega_2$, by selecting the rotational speeds of the other drums on the basis of the relation $\omega_2=(r_1/r_2)\times\omega_1$, it is possible to obtain the multi-image without discrepancy in colors, and further, even if the image is formed with the black toner alone and the photosensitive drums for the other colors are not used, the photosensitive drum for black color alone does not become the premature non-usable condition.

Next, a fifth embodiment of the present invention will be explained.

In this embodiment, the protection layer 90 having the function to enhance the durability of the photosensitive member (drum) as described in connection with the first embodiment is applied to the photosensitive drum for black color alone, and such protection layer is not provided on the photosensitive sensitive drums for the other colors.

With this arrangement, since the cost of the photosensitive drums for colors other than black can be reduced, the total cost of the apparatus can also be reduced with enhancing the maintenance thereof.

Next, a sixth embodiment of the present invention will be explained.

Contrary to the above fifth embodiment, in this embodiment, the object is achieved by changing the feature of the protection layers 90 in accordance with the toner colors, without omitting the protection layers. More particularly, for example, when the protection layer is made of polycarbonate dispersing Teflon particles therein, the more the amount of the Teflon particles dispersed in the polycarbonate, the higher the durability of the protection layer, but the higher the cost thereof. Thus, only for the protection layer of the photosensitive layer of the black color drum which must have the high durability, the amount of the Teflon particles dispersed in the polycarbonate is increased, and, the amount of Teflon particles is decreased for the protection layers of the photosensitive drums for the other colors.

In this way, by using a protection layer having the higher durability as the protection layer of the photosensitive drum which must have the higher durability more than those of the other photosensitive drums, it is possible to reduce the frequency in replacement of the photosensitive drum, thus improving the maintenance and service.

As mentioned above, among a plurality of photosensitive members, by changing the construction of the specific photosensitive member having the higher frequency in use, it is possible to increase the durability of the specific photosensitive member. Even if such change in construction causes any drawback, such drawback can be eliminated by adopting any suitable solution, and, the service life of the specific photosensitive member can be lengthened without any problems, thus improving the maintenance of the whole image forming apparatus.

Incidentally, while the layer referred to as the "protection layer" may have the function to protect the photosensitive member, such layer is not limited to a layer for exclusively protecting the member, but, the photosensitive layer itself of the photosensitive member may be thickened. In this case, a portion of the thickened photosensitive layer is also regarded as the protection layer in the present invention. Further, while the photosensitive member was embodied as the drum, it may comprise a belt. In addition, while the multi-image was embodied as the full-color image, the present invention can be applicable to the formation of a multi-image with only black toner and red toner.

What is claimed is:

1. An image forming apparatus, comprising:

a plurality of image bearing bodies each having a surface protective layer; and a plurality of image forming means for forming an image of different colors onto each of said image bearing bodies;

wherein said image forming apparatus has a first mode where image formation is effected by all of said image bearing bodies, and a second mode where image formation is effected only by at least one predetermined image bearing body, and the surface protective layer of said at least one predetermined image bearing body is selected so as to be thicker than that of the other image bearing bodies.

2. An image forming apparatus according to claim 1, wherein said plural image bearing bodies are photosensitive bodies, and said surface protective layers are formed thereon.

3. An image forming apparatus according to claim 1, wherein said surface protective layers have polytetrafluoroethylene dispersed therein.

4. An image forming apparatus according to claim 1, wherein said plural image bearing bodies are photosensitive bodies, and each of plural image bearing bodies has charge means, exposure means for irradiating light onto said photosensitive body, development means for developing latent image formed on said photosensitive body, transfer means for transferring the developed image onto a recording material, and cleaning means for cleaning residual material on said photosensitive body.

5. An image forming apparatus according to claim 4, wherein an exposure amount for said at least one predetermined image bearing body is selected to be larger than that for said other image bearing bodies.

6. An image forming apparatus according to claim 4, wherein said cleaning means has plurality of blades each capable of contacting with each of said plural image bearing bodies, all of cleaning blades being contacted onto said plural image bearing bodies in the first mode, while said blades contacting only with said at least one predetermined image bearing body in the second mode.

7. An image forming apparatus according to claim 1, wherein said plural photosensitive bodies are removably attached to a main body of said image forming apparatus.

8. An image forming apparatus according to claim 1, wherein the images of different colors include yellow, magenta, cyan and black, and the image of black color is formed on said at least one predetermined image bearing body.

9. An image forming apparatus according to claim 1, wherein the thickness of the surface protective layer of said at least one predetermined image bearing body is selected so as to be twice that of said other image bearing bodies.

10. An image forming apparatus, comprising:

a plurality of photosensitive bodies each having a photosensitive layer;

a plurality of image forming means for forming an image of different colors on each of said plural photosensitive bodies;

wherein said image forming apparatus has a first mode where image formation is effected by plural image bearing bodies, and a second mode where the image formation is effected only by at least one predetermined photosensitive body, said at least one predetermined photosensitive body having a surface protective layer thereon while the other photosensitive bodies have an exposed photosensitive layer.

11. An image forming apparatus according to claim 10, wherein said surface protective layer is formed on said photosensitive layer of said at least one predetermined photosensitive body.

12. An image forming apparatus according to claim 10, wherein said surface protective layer has polytetrafluoroethylene dispersed therein.

13. An image forming apparatus according to claim 10, wherein each of said image forming means has charge means for charging said photosensitive body, exposure means for irradiating light onto said photosensitive body, development means for developing latent image formed on said photosensitive body, transfer means for transferring the developed image onto a recording material, and cleaning means for removing residual material on said photosensitive body.

14. An image forming apparatus according to claim 13, wherein an exposure amount for said at least one predetermined photosensitive body is selected so as to be larger than that for said other photosensitive bodies.

15. An image forming apparatus according to claim 13, wherein said cleaning means has plurality of blades each capable of contacting with each of said plural photosensitive bodies, all of cleaning bodies being contacted onto said plural photosensitive bodies in the first mode, while said blades contacting only with said at least one predetermined photosensitive body in the second mode.

16. An image forming apparatus according to claim 10, wherein said plural photosensitive bodies are removably attached to a main body of said image forming apparatus.

17. An image forming apparatus according to claim 10, wherein the images of different colors include yellow, magenta, cyan and black, and the image of black color is formed on said at least one predetermined photosensitive body.

18. An image forming apparatus, comprising:

a plurality of image bearing bodies each having a surface protective layer with polytetrafluoroethylene dispersed therein; and a plurality of image forming means for forming an image of different colors onto each of said image bearing bodies;

wherein said image forming apparatus has a first mode where image formation is effected by all of said image bearing bodies, and a second mode where image formation is effected only by at least one predetermined image bearing body, said dispersing amount of polytetrafluoroethylene in said at least one predetermined image bearing body being larger than that in the other image bearing bodies.

19. An image forming apparatus according to claim 18, wherein said image bearing bodies are photosensitive bodies, and said surface protective layers are formed thereon.

20. An image forming apparatus according to claim 18, wherein said plural image bearing bodies are photosensitive bodies, and each of plural image bearing bodies has charge means, exposure means for irradiating light onto said photosensitive body, development means for developing latent image formed on said photosensitive body, transfer means for transferring the developed image onto a recording material, and cleaning means for cleaning residual material on said photosensitive body.

21. An image forming apparatus according to claim 20, wherein an exposure amount for said at least one predetermined image bearing body is selected so as to be larger than that for said other image bearing bodies.

22. An image forming apparatus according to claim 20, wherein said cleaning means has plurality of blades each capable of contacting each of said plural image bearing bodies, all of cleaning blades being contacted onto said plural image bearing bodies in the first mode, while said blades contacting only with said at least one predetermined image bearing body in the second mode.

23. An image forming apparatus according to claim 18, wherein said plural photosensitive bodies are removably attached to a main body of said image forming apparatus.

24. An image forming apparatus according to claim 18, wherein the images of different colors include yellow, magenta, cyan and black, and the image of black color is formed on said at least one predetermined image bearing body.

25. An image forming apparatus according to claim 18, wherein said surface protective layers are formed by dispersing polytetrafluoroethylene into a polycarbonate.

26. An image forming apparatus, comprising:

a plurality of photosensitive bodies each having a photosensitive layer;

a plurality of image forming means for forming image of different colors on each of said plural photosensitive bodies;

wherein said image forming apparatus has a first mode where image formation is effected by a plurality of photosensitive bodies, and a second mode where the image formation is effected by at least one predetermined photosensitive body, said at least one predetermined photosensitive body made of an inorganic material, while the other photosensitive bodies are made of an organic material.

27. An image forming apparatus according to claim 26, wherein each of said image forming means has charge means for charging said photosensitive body, exposure means for irradiating light onto said photosensitive body, development means for developing a latent image formed on said photosensitive body, transfer means for transferring the developed image onto a recording material, and cleaning means for removing residual material on said photosensitive body.

28. An image forming apparatus according to claim 26, wherein said plural photosensitive bodies are removably attached to a main body of said image forming apparatus.

29. An image forming apparatus according to claim 26, wherein the images of different colors include yellow, magenta, cyan and black, and the image of black color is formed on said at least one predetermined image bearing body.

30. An image forming apparatus according to claim 26, wherein said cleaning means has plurality of blades each capable of contacting each of said plural photosensitive bodies, all of cleaning blades being contacted onto said plural photosensitive bodies in the first mode, while said blades contacting only with said at least one predetermined photosensitive body in the second mode.

31. An image forming apparatus according to claim 26, wherein said inorganic material is an amorphous silicone.

32. An image forming apparatus according to claim 26, wherein said inorganic material is a selenium material.

* * * * *

UNITED STATES PATENT AND TRADEMARK OFFICE

CERTIFICATE OF CORRECTION

PATENT NO. : 5,202,727

DATED : April 13, 1993

INVENTOR(S) : IZUMIZAKI, et al.

It is certified that error appears in the above-indentified patent and that said Letters Patent is hereby corrected as shown below:

ON THE TITLE PAGE:

[56] References Cited

U.S. PATENT DOCUMENTS, "5,063,130 11/9991 Kato et al." should read --5,063,130 11/1991 Kato et al.--.

COLUMN 1

Line 15, "Among them, as" should read --As--.

Line 19, "paper therefore" should read --paper, and therefore--.

COLUMN 2

Line 11, "a" should be deleted.

COLUMN 3

Line 65, "disadvantages" should read --disadvantage--.

COLUMN 4

Line 12, "will" should read --will be--.

COLUMN 6

Line 2, "but," should read --but--.

UNITED STATES PATENT AND TRADEMARK OFFICE

CERTIFICATE OF CORRECTION

PATENT NO. : 5,202,727

DATED : April 13, 1993

INVENTOR(S) : IZUMIZAKI, et al.

It is certified that error appears in the above-indentified patent and that said Letters Patent is hereby corrected as shown below:

COLUMN 6

Line 2, "but," should read --but--.

Signed and Sealed this

Twenty-ninth Day of March, 1994

Bruce Lehman

*Attest:*

BRUCE LEHMAN

*Attesting Officer*

*Commissioner of Patents and Trademarks*